United States Patent [19]

Nakajima et al.

[11] Patent Number: 4,822,263

[45] Date of Patent: Apr. 18, 1989

[54] SLIDING-VANE ROTARY COMPRESSOR

[75] Inventors: Nobuyuki Nakajima; Kenichi Inomata; Shigeru Okada, all of Konan, Japan

[73] Assignee: Diesel Kiki Co., Ltd., Tokyo, Japan

[21] Appl. No.: 107,364

[22] Filed: Oct. 9, 1987

[30] Foreign Application Priority Data

Oct. 27, 1986 [JP] Japan ..... 61-255234

[51] Int. Cl.[4] ..... F04C 18/344

[52] U.S. Cl. ..... 418/133; 418/270

[58] Field of Search ..... 417/269; 418/135, 259, 418/270

[56] References Cited

U.S. PATENT DOCUMENTS

| | | | |
|---|---|---|---|
| 4,207,033 | 6/1980 | Drutchas | 418/135 |
| 4,299,593 | 11/1981 | Shibuya | 417/269 |
| 4,401,414 | 8/1983 | Ishizuka | 417/269 |
| 4,502,854 | 3/1985 | Shibuya | 418/133 |
| 4,538,976 | 3/1985 | Shibuya | 418/259 |
| 4,608,002 | 8/1986 | Hayase | 418/270 |
| 4,668,172 | 5/1987 | Shibuya | 418/270 |

FOREIGN PATENT DOCUMENTS

| | | | |
|---|---|---|---|
| 143015 | 12/1978 | Japan | 418/259 |
| 110891 | 8/1983 | Japan | 418/259 |
| 160593 | 7/1986 | Japan | 418/259 |

*Primary Examiner*—William L. Freeh

*Attorney, Agent, or Firm*—Wenderoth, Lind & Ponack

[57] ABSTRACT

In a sliding-vane rotary compressor, one of the opposite open ends of a cylinder is closed by a first head, the other open end being closed by a side block to which is secured a second head so as to define jointly with the side block a low pressure chamber and a high pressure chamber. With this construction, one side block can be omitted and hence the number of structural components is reduced. Preferably, a displacement adjustment mechanism is incorporated in the side block and the second head for adjusting the displacement of the compressor.

4 Claims, 10 Drawing Sheets

SLIDING-VANE ROTARY COMPRESSOR

BACKGROUND OF THE INVENTION

1. Field of the Invention:

The present invention relates to a sliding-vane rotary compressor suitable for use in an automotive air conditioning system.

2. Prior Art:

A known sliding-vane rotary compressor disclosed in Japanese Patent Laid-open Publication No. 60-204992, for example, includes a circular rotor rotatably disposed in a substantially elliptical bore in a cylinder for sliding contact with the inner wall of the cylinder along a minor axis of the elliptical bore so as to define therebetween two operating compartments disposed in symmetric relation to one another. The rotor carries thereon a plurality of radially movable vanes slidably engageable with the inner wall of the cylinder. The cylinder, the rotor and the vanes define therebetween compression chambers which vary in volume with each revolution of the rotor. Opposite open ends of the cylinder are closed by two side blocks to which are connected heads to define between the corresponding side blocks a high pressure chamber and a low pressure chamber, respectively. A gas sucked from the low pressure chamber through intake holes into the compression chambers is compressed in the compression chambers and then discharged therefrom through discharge holes into the high pressure chamber.

With this construction, the side block and the head disposed on each side of the cylinder are necessary for the formation of the high and low pressure chambers with the result that the known compressor requires an increased number of structural components and hence is costly to manufacture.

SUMMARY OF THE INVENTION

It is therefore an object of the present invention to provide a sliding-vane rotary compressor incorporating structural features which enable omission of one side block or head to reduce the number of structural components and lower the manufacturing cost.

Another object of the present invention is to provide a sliding-vane rotary compressor having a rigid integral head which corresponds to a conventional combination of the side block and the head.

A further object of the present invention is to provide a sliding-vane rotary compressor with one side block or head omitted, which has structural features for enabling an adjustable control of the displacement of the compressor according to operating conditions.

According to a first aspect of the present invention, there is provided a sliding-vane rotary compressor comprising:

a cylinder having an intake hole and a discharge hole, and a rotor rotatably disposed in the cylinder so as to define therebetween an operating compartment, the rotor carrying thereon a plurality of approximately radially movable sliding vanes, there being defined between the cylinder, the rotor and the vanes a plurality of compression chambers which vary in volume with each revolution of the rotor so as to compress a gas sucked therein through the intake hole and thereafter discharge the compressed gas therefrom through the discharged hole;

a first head closing one of opposite open ends of the cylinder;

a side block closing the other open end of the cylinder;

a second head secured to the side block; and the side block and the second head defining therebetween a low pressure chamber communicating with the intake hole and a high pressure chamber communicating with the discharge hole.

With this construction, one of the open ends of the cylinder is closed solely by the first head, so that a side block on this side can be omitted. With this omission, the number of structural components is reduced and hence the compressor can be manufactured at a low cost.

According to a second aspect of the present invention, there is provided a sliding-vane rotary compressor comprising:

a cylinder having an intake hole and a discharge hole, and a rotor rotatably disposed in the cylinder so as to define therebetween an operating compartment, the rotor carrying thereon a plurality of approximately radially movable sliding vanes, there being defined between the cylinder, the rotor and the vanes a plurality of compression chambers which vary in volume with each revolution of the rotor so as to compress a gas sucked therein through the intake hole and thereafter discharge the compressed gas therefrom through the discharged hole;

a first head closing one of opposite open ends of the cylinder;

a side block closing the other open end of the cylinder;

a second head secured to the side block;

the side block and the second head defining therebetween a low pressure chamber communicating with the intake hole and a high pressure chamber communicating with the discharge hole; and a displacement-adjustment mechanism incorporated in the side block and the second head for adjusting displacement of the compressor.

With this construction, the compressor is capable of adjusting the displacement thereof.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
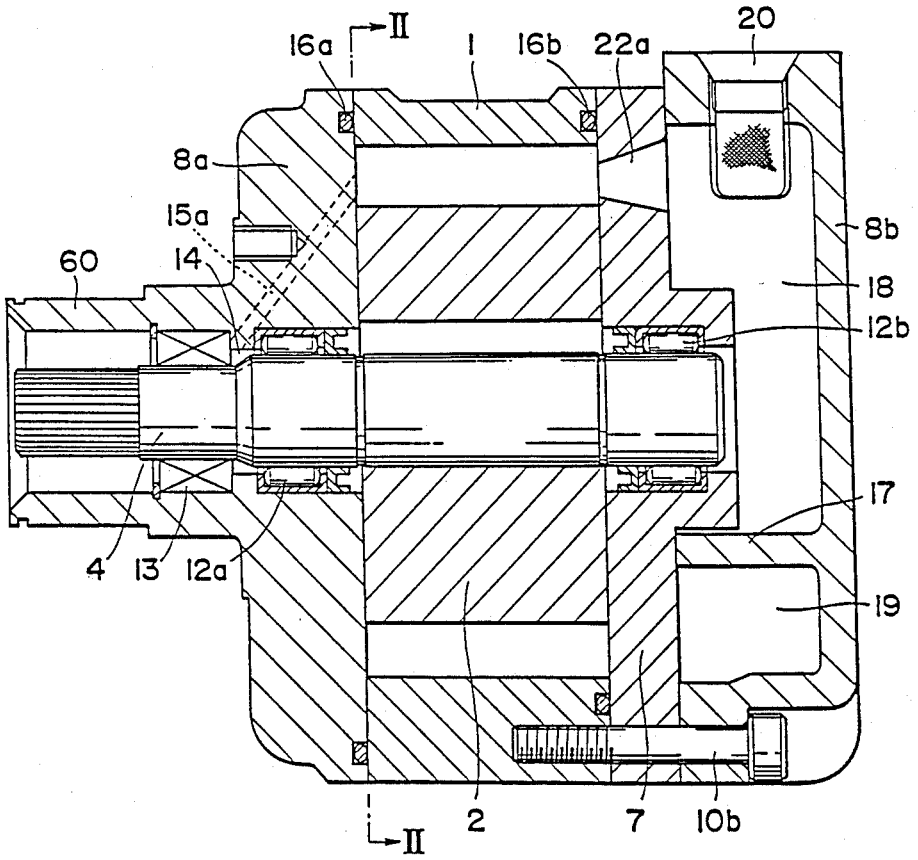
FIG. 1 is a longitudinal cross-sectional view taken along line I—I of FIG. 3, showing a first embodiment of sliding-vane rotary compressor according to the present invention.
Figure 2:
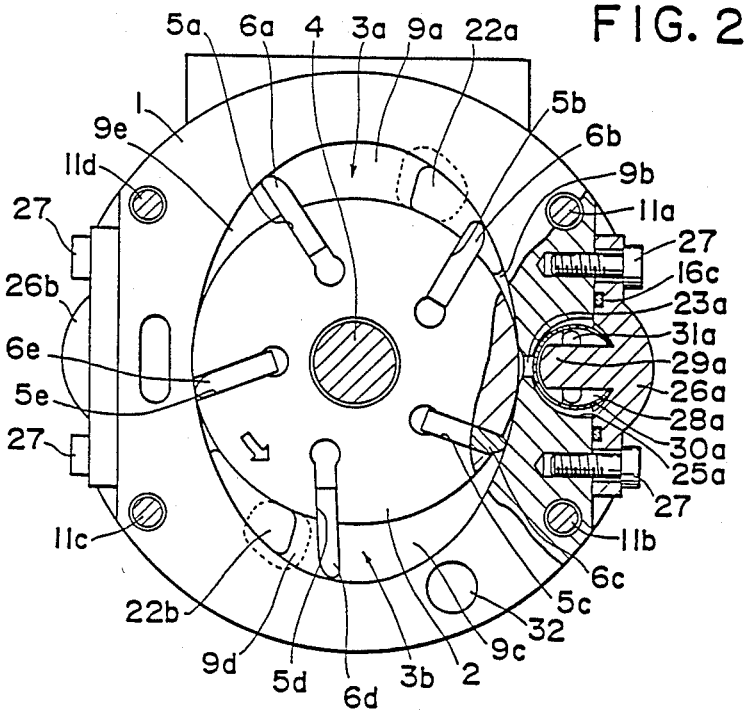
FIG. 2 is a cross-sectional view taken along line II—II of FIG. 1.
Figure 3:
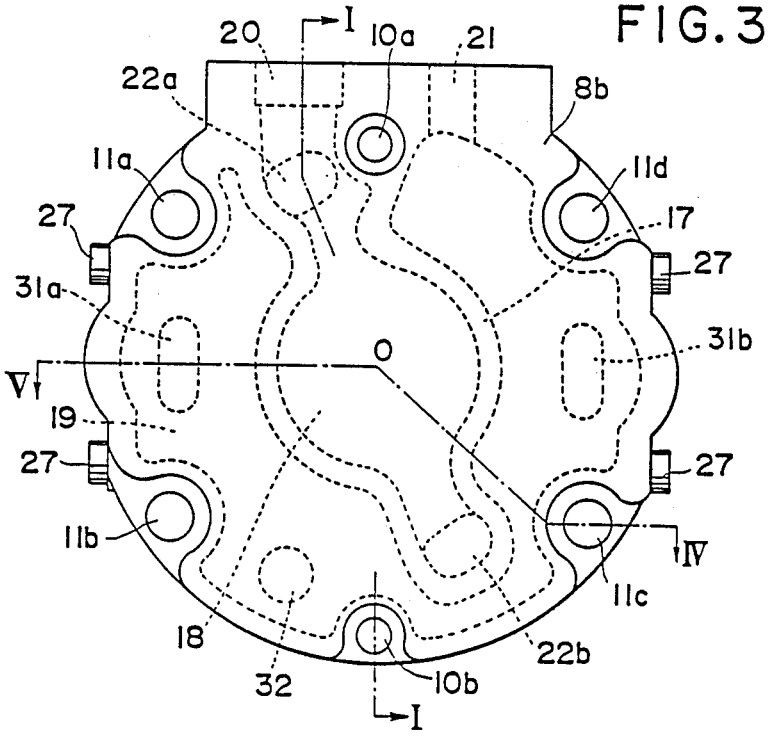
FIG. 3 is a side view of a rear end of the compressor.
Figure 4:
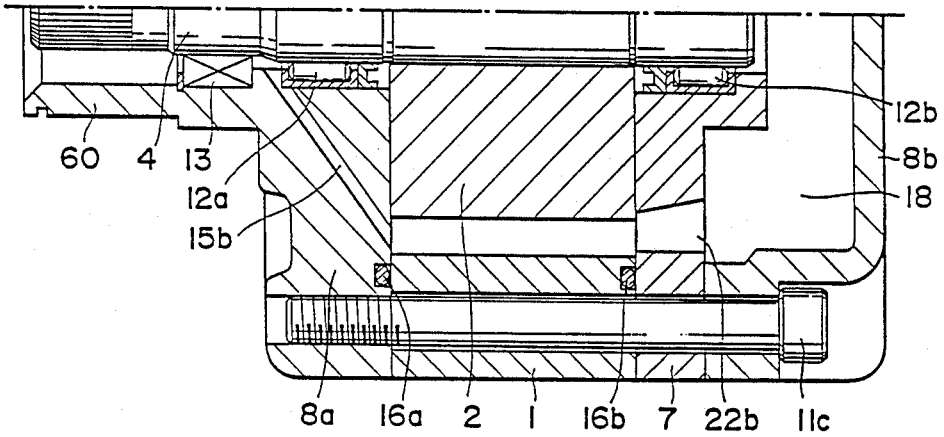
FIG. 4 is a cross-sectional view taken along line O—IV of FIG. 3.
Figure 5:
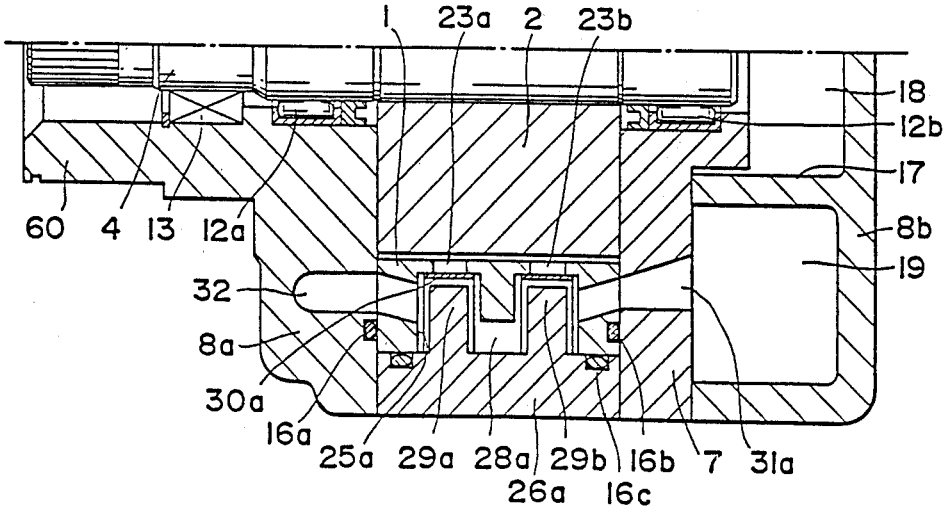
FIG. 5 is a cross-sectional view taken along line O—V of FIG. 3.
Figure 6:
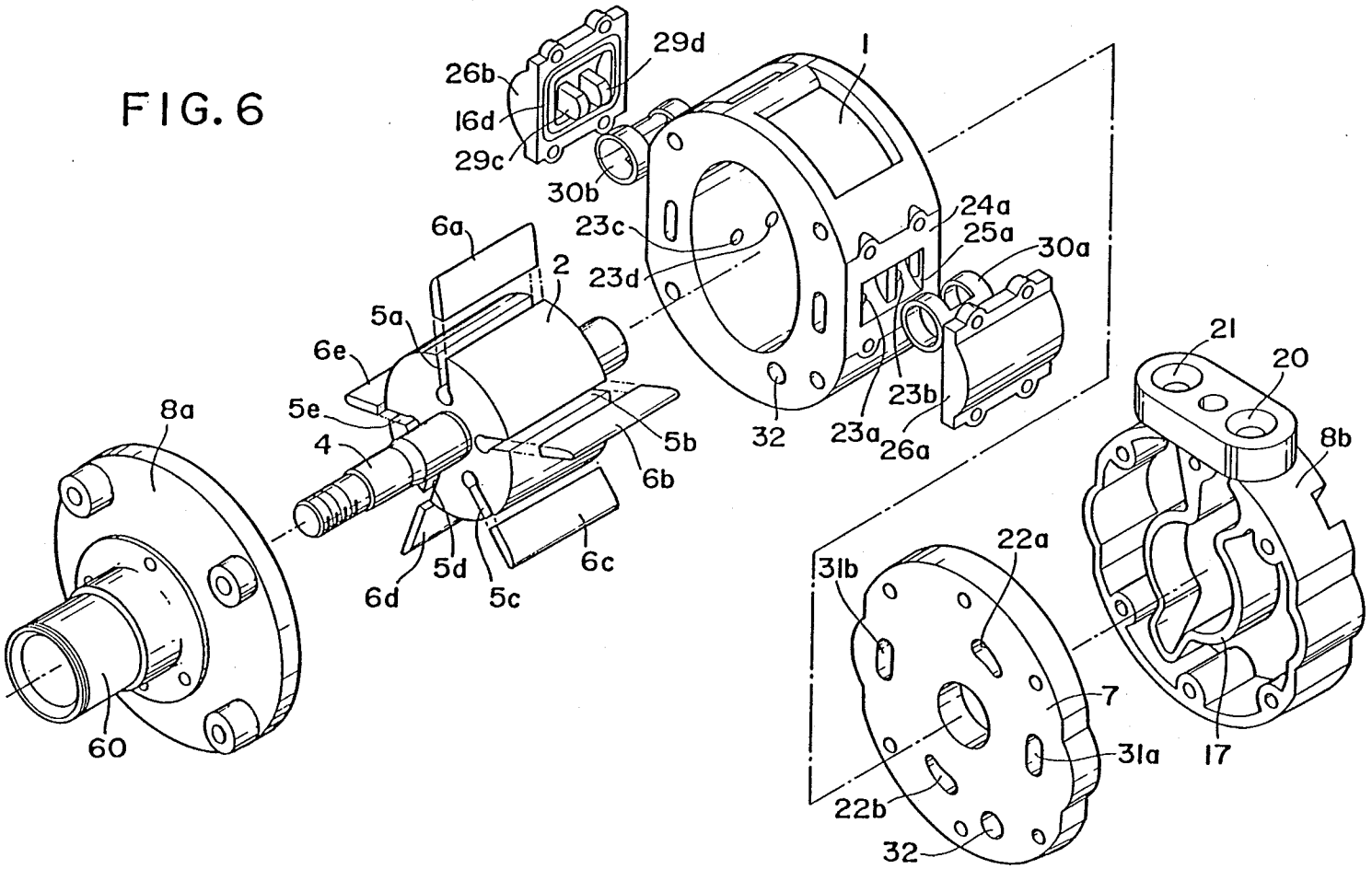
FIG. 6 is an exploded perspective view showing essential structural components of the compressor.
Figure 7:
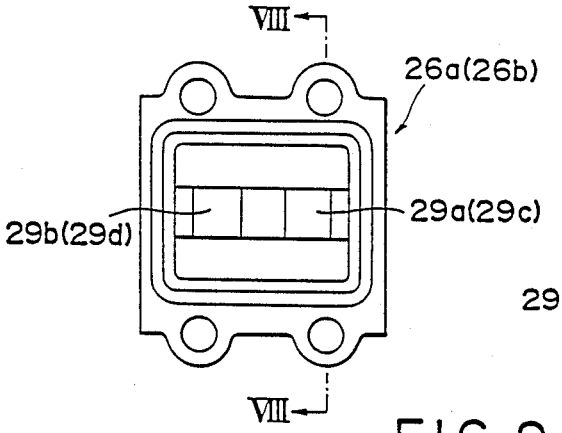
FIG. 7 is a rear view of a cover of the compressor.

FIGS. 1 through 6 show a first embodiment of sliding-vane rotary compressor of the present invention used for compressing a refrigerant, for example. The compressor includes a cylinder 1 and a rotor 2 rotatably disposed in a substantially elliptical bore in the cylinder 1. The rotor 2 is sealingly engageable with the inner wall of the cylinder 1 along a minor axis of the elliptical bore so that there are defined between the rotor 2 and the cylinder 1 two operating compartments 3*a*, 3*b* disposed in diametrically opposite, symmetric relation to one another. The rotor 2 is fixedly mounted on a drive shaft 4 in concentric relation thereto and includes a plurality (five in the illustrated embodiment) of approximately radial slots 5*a*–5*e* in which vanes 6*a*–6*e* are slidably inserted, respectively.

A side block 7 is secured to a rear end face of the cylinder 1 to close a rear open end of the latter and has an outer peripheral wall extending flush with the outer peripheral wall of the cylinder 1. Likewise, a first head 8*a* is secured to a front end face of the cylinder 1 to close a front open end of the latter and has an outer peripheral wall extending flush with that of the cylinder 1. That is, the opposite open ends of the cylinder 1 are closed by the side block 7 and the first head 8*a* with the rotor 2 and the vanes 6*a*–6*e* held in sliding contact with inner walls of the side block 7 and the first head 8*a*. Thus, there are five compression chambers 9*a*–9*e* defined between the cylinder 1, the rotor 2, the vanes 6*a*–6*e*, the side block 7 and the first head 8*a*.

A second head 8*b* is disposed outside the side block 7. The cylinder 1, the side block 7 and the second head 8*b* are fastened together by two screw fasteners 10*a*, 10*b*. On the other hand, the cylinder 1, the side block 7 and the first and second heads 8*a*, 8*b* are fastened together by four screw fasteners 11*a*–11*d*.

The drive shaft 4 is rotatably supported by the side block 7 and the first head 8*a* via a pair of radial bearings 12*a*, 12*b*. The first head 8*a* includes a central hollow cylindrical hub 60 projecting toward the front side for receiving therein an electromagnetic clutch (not shown). The drive shaft 4 has an end portion extending longitudinally in the hub 60 for being releasably coupled with an engine crankshaft (not shown) via the clutch to receive the engine torque. A mechanical seal 13 is disposed between the end portion of the drive shaft 4 and the first head 8*a*. The mechanical seal 13 and one of the radial bearings 12*a* define therebetween a low pressure guide chamber 14 communicating through a pair of low pressure guide grooves 15*a*, 15*b* with the compression chambers 9*a*–9*e* while the latter are in the suction stroke so that a refrigerant gas entraining a lubricating oil is introduced in the low pressure guide chamber 14, supplying the lubricating oil to the mechanical seal 13 and the radial bearing 12*a*. Since the mechanical seal 13 and the surrounding areas are kept under low pressure, the load on the mechanical seal 13 is reduced. This ensures that the mechanical seal 13 is able to operate reliably over a prolonged period of time. In the illustrated embodiment, the five vanes 6*a*–6*e* define therebetween the five compression chambers 9*a*–9*b* two of which are adapted to be connected in different phases with the low pressure guide chamber 14 during the suction stroke. Due to this phase difference, the lubricating oil flows back-and-forth through the low pressure guide grooves 15*a*, 15*b* to continuously fill the low pressure guide chamber 14.

The cylinder 1, the side block 7 and the heads 8*a*, 8*b* have respective flat confronting end surfaces engageable flatwise with each other to provide a hermetic seal with or without a separate sealing means disposed therebetween. In the illustrated embodiment, a pair of first and second O-rings 16*a*, 16*b* is interposed respectively between the side block 7 and the cylinder 1 and between the cylinder 1 and the first head 8*a*.

The second head 8*b* has an integral partition wall 17 held in contact with the side block 7 with a gasket (not shown) interposed therebetween. With the partition wall 17 thus provided, there are defined between the side block 7 and the second head 8*b* a low pressure chamber 18 and a high pressure chamber 19 separated by the partition wall 17. The low and high pressure chambers 18, 19 are connected respectively with an intake port 20 and a discharge port 21 which are defined in an upper portion of the second head 8*b*. The low pressure chamber 18 is connected to the operating compartments 3*a*, 3*b* via a pair of intake holes 22*a*, 22*b* defined in the side block 7 in diametrically opposite relation to one another. The intake holes 22*a*, 22*b* communicate with the compression chambers 9*a*–9*e* as the latter increase in volume during the suction stroke whereupon the refrigerant gas is sucked from the low pressure chamber 18 through the intake holes 22*a*, 22*b* into the compression chambers 9*a*–9*e*.

The cylinder 1 has two sets of discharge holes 23*a*–23*d* extending radially across the peripheral wall of the cylinder 1. The discharge holes 23*a*–22*d* have their one ends opening to the operating compartments 3*a*, 3*b* at diametrically opposite portions of the inner wall of the cylinder 1 which extend along the minor axis of the elliptical bore. The outer peripheral surface of the cylinder 1 is flattened at two diametrically opposite portions thereof to form a pair of flat cover attachment portions 24*a* (only one shown). Each of the cover attachment portions 24*a* includes a recess 25*a* having two laterally spaced arcuate grooves to which the other ends of each respective set of the discharge holes 23*a*–22*d* are open.

A pair of covers 26*a*, 26*b* is secured to the cover attachment portions 24*a*, respectively, by means of four screw fasteners 27 threading through the covers 26*a*, 26*b* into the cylinder 1. Disposed respectively between the covers 26*a*, 26*b* and the cover attachment portions 24*a* are a pair of third O-rings 16*c*, 16*d* extending around the recess 25*a* to provide hermetic seals. Each of the covers 26*a*, 26*b* has a recessed arcuate inner wall so that there is defined between the cover 26*a*, 26*b* and the recess 25*a* in the cylinder 1 a valve-receiving chamber 28*a*. The cover 26*a*, 26*b* also includes two laterally spaced stopper projections 29*a*, 29*b*; 29*c*, 29*d* extending toward the cylinder 1 in alignment with the respective discharge holes 23*a*, 23*b*; 23*c*, 23*d*. The valve-receiving chambers 28*a* receive respectively therein a pair of discharge valves 30*a*, 30*b*. Each of the discharge valves 30*a*, 30*b* is formed from a sheet of resilient material into a split tube having a longitudinal slit. The tubular discharge valve 30*a*, 30*b* is spread against its own resiliency when it is retained on the stopper projections 29*a*–29*e* of the cover 26*a*, 26*b*. The discharge valve 29*a* thus attached has outer peripheral portions normally held in contact with the bottom wall of the recess 25*a* to close the open ends of the respective discharge holes 23*a*–23*d*.

The high pressure chamber 19 and one end of each of the valve-receiving chambers 28*a* are held in fluid communication with each other by means of a pair of first discharge connecting holes 31*a*, 31*b* extending through the cylinder 1 and the side block 7. The other end of each valve receiving chamber 28*a* is connected with the high pressure chamber 19 via a second discharge connecting hole 32 extending through the cylinder 1, the first head 8*a* and the side block 7. The second discharge connecting hole 32 is formed in zigzag fashion for separating the lubricating oil entrained in the discharged refrigerant gas to collect the separated lubricating oil into the bottom of the high pressure chamber 19. The first and second discharge holes 31*a*, 31*b*, 32 are disposed radially inwardly of the first and second O-rings 16*a*, 16*b* so that they are held gas-tight against leakage.

With this construction, when the drive shaft 4 is driven to rotate the rotor 2 in one direction, the vanes 6*a*–6*e* slide along the inner wall of the cylinder 1 to cause the compression chambers 9*a*–9*e* to successively increase and decrease in size with each revolution of the rotor 2. As the compression chambers 9*a*–9*e* increase in size or volume during the intake or suction stroke, they are brought to fluid communication with the low pressure chamber 18 through the intake holes 22*a*, 22*b*, whereupon a refrigerant gas which has been introduced from the intake port 20 into the low pressure chamber 18 is drawn into the compression chambers 9*a*–9*e* through the intake holes 22*a*, 22*b*. Then the compression chambers 9*a*–9*e* gradually decrease in size and when succeeding vanes 6*a*–6*e* move past the intake holes 22*a*, 22*b*, the gas is trapped in the compression chambers 9*a*–9*e*. Thus, the compression is commenced. A further movement of the rotor 2 causes the preceding vanes 6*a*–6*e* to move past the discharge holes 23*a*–23*d* whereupon the compression chambers 9*a*–9*e* communicate with the discharge holes 23*a*–23*d* and then the discharge valves 30*a*, 30*b* are forced by the pressure in the compression chambers 9*a*–9*e* to retract away from the discharge holes 23*a*–23*d* until the valves 30*a*, 30*b* engage the stopper projections 29*a*–29*e* of the covers 26*a*, 26*b*. Consequently, the gas is discharged from the compression chambers 9*a*–9*e* through the discharge holes 23*a*–23*d* into the valve-receiving chambers 28*a*. Then the gas flows through the discharge connecting holes 31*a*, 31*b*, 32 into the high pressure chamber 19, and finally is discharged from the discharge port 21 to the outside of the compressor.

Figure 9:
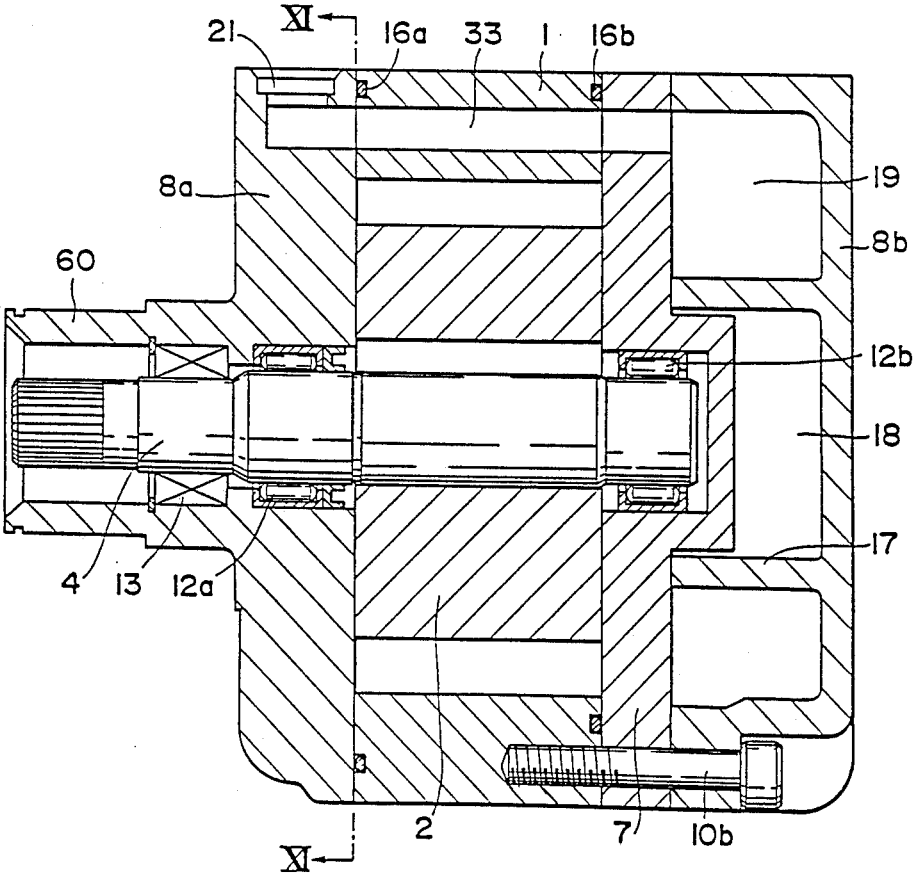
FIG. 9 is a longitudinal cross-sectional view taken along line IX—IX of FIG. 10, showing a second embodiment of sliding-vane rotary compressor according to the present invention.
Figure 10:
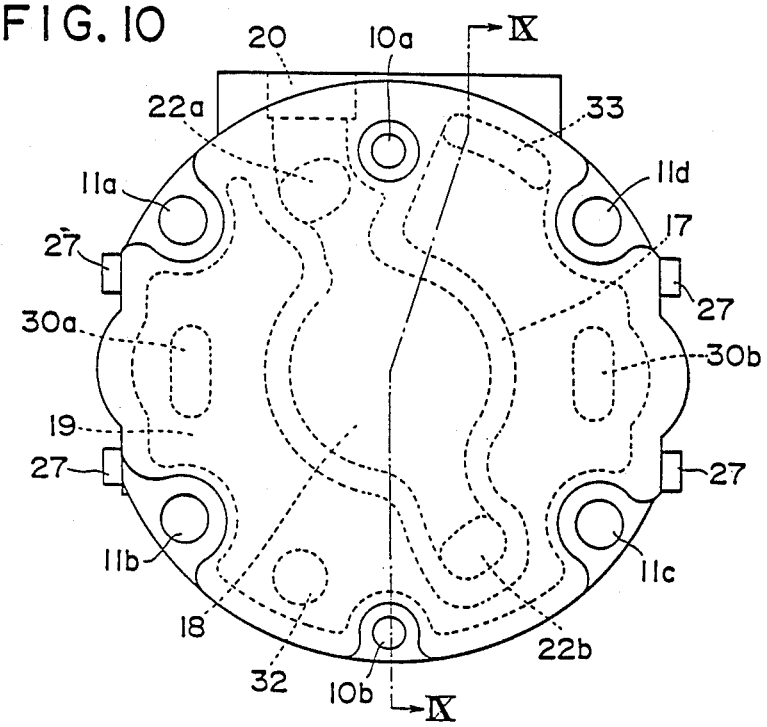
FIG. 10 is a side view of a rear end of the compressor shown in FIG. 9.
Figure 11:
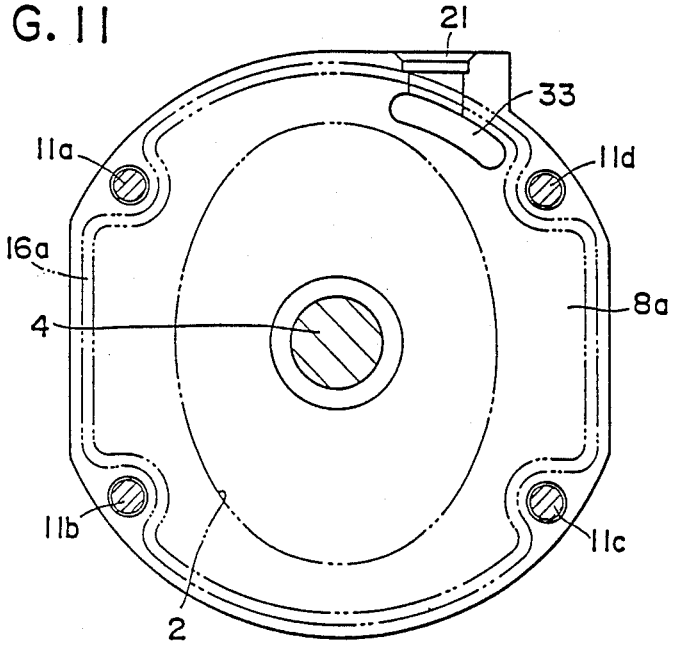
FIG. 11 is a cross-sectional view taken along line XI—XI of FIG. 9.
Figure 12:
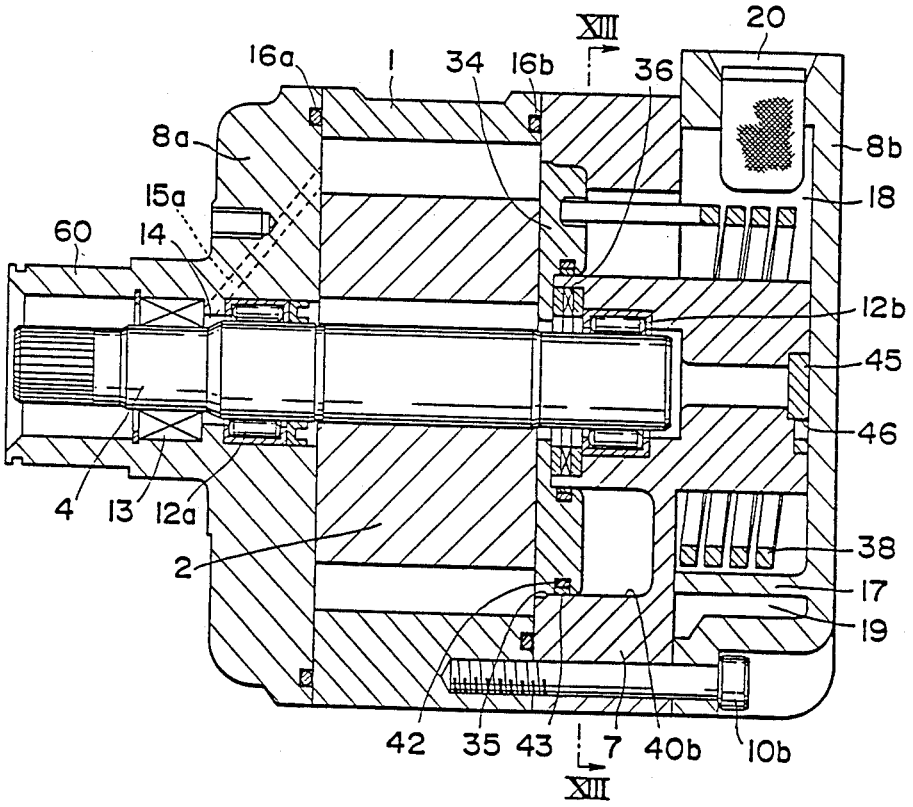
FIG. 12 is a longitudinal cross-sectional view taken along line XII—XII of FIG. 14, showing a third embodiment of sliding-vane rotary compressor according to the present invention.

A second embodiment shown in FIGS. 9–11 differs from the foregoing embodiment in that the compressor has a discharge port 21 formed in a first head 8*a* and connected in fluid communication with a high pressure chamber 19 defined in a second head 8*b* via a third discharge connecting hole 33 which extends successively through the first head 8*a*, the cylinder 1 and the side block 7. The discharge port 21 and an intake port 20 are disposed on the front side and the rear side, respectively, of the compressor. This arrangement will suffice for the requirement on the position of the intake and discharge ports when the compressor is incorporated in a different vehicle or refrigerator.

Other structural details of the compressor are the same as those of the foregoing embodiment and hence will require no further description. For easy reference, like or corresponding parts are indicated by the same reference characters throughout several views.

According to a third embodiment shown in FIGS. 12 through 17, a sliding-vane rotary compressor includes a displacement-adjustment mechanism incorporated in a side block 7 and a second head 8*b*. The compressor of this embodiment is the same as the compressor of the first-mentioned embodiment except the shape and internal construction of the side block 7 and the second head 8*b*.

The displacement-adjustment mechanism is the same in principle as the mechanism as shown in Japanese Utility Model Laid-open Publication No. 55-2000. The mechanism includes a ring-shaped adjustment member 34 for adjusting the compression starting position. The adjustment member 34 is rotatably fitted in an annular groove 35 formed in one surface of the side block 7 facing the cylinder 1. The adjustment member 34 has a pair of diametrically opposite peripheral cut-out recesses 37*a*, 37*b* normally held in communication with a pair of intake holes 22*a*, 22*b*, respectively, formed in the side block 7. With this arrangement, the circumferential position of the cut-out recesses 37*a*, 37*b* varies with angular displacement of the adjustment member 34, thereby enabling adjustment of the compression starting position, i.e. the position in which the vanes 6*a*–6*e* begins to block fluid communication between compression chambers 9*a*–9*e* and the intake holes 23*a*, 23*b*.

Figure 13:
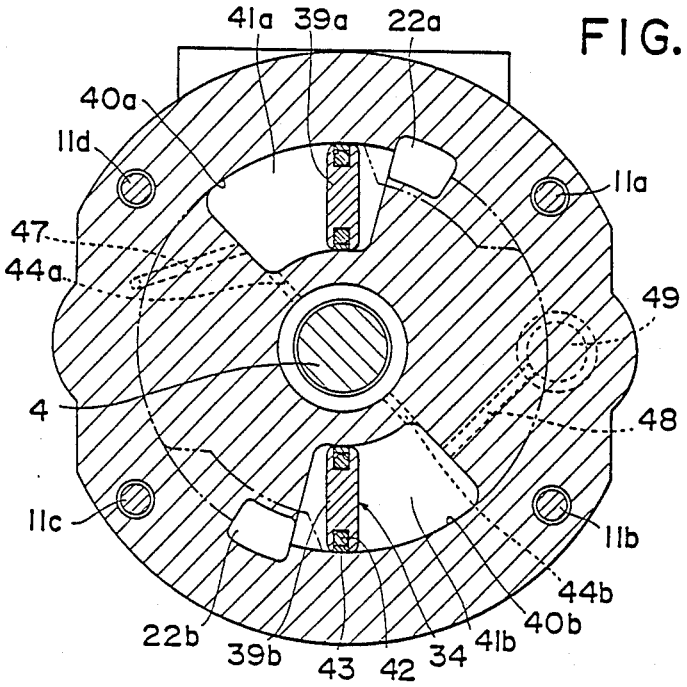
FIG. 13 is a cross-sectional view taken along line XIII—XIII of FIG. 12.
Figure 14:
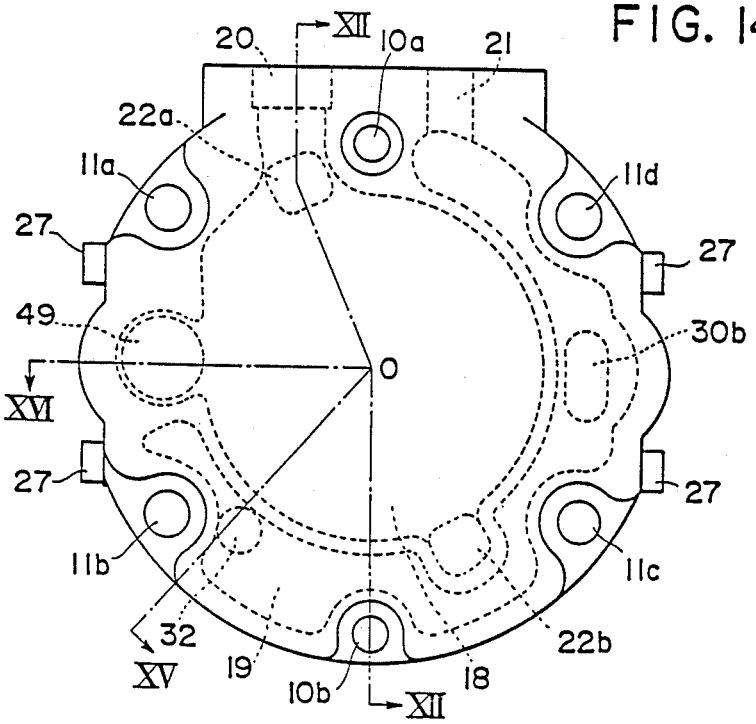
FIG. 14 is a side view of a rear end of the compressor shown in FIG. 12.
Figure 15:
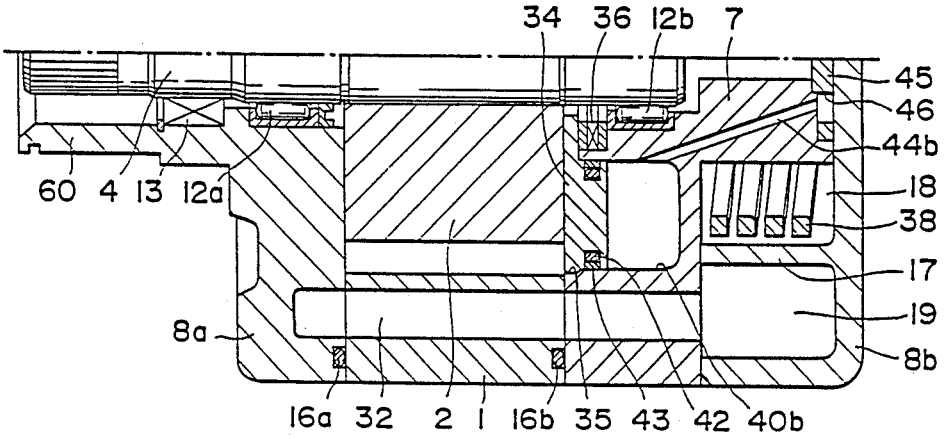
FIG. 15 is a cross-sectional view taken along line O—XV of FIG. 14.
Figure 16:
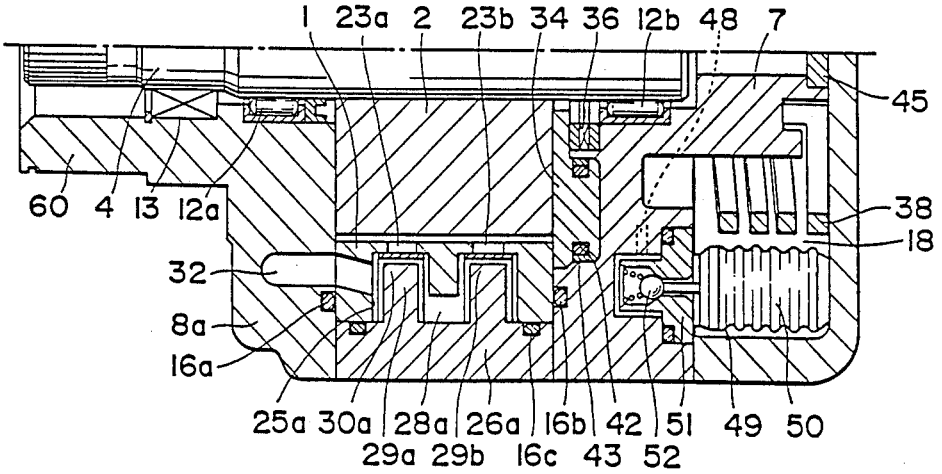
FIG. 16 is a cross-sectional view taken along line O—XVI of FIG. 14.
Figure 17:
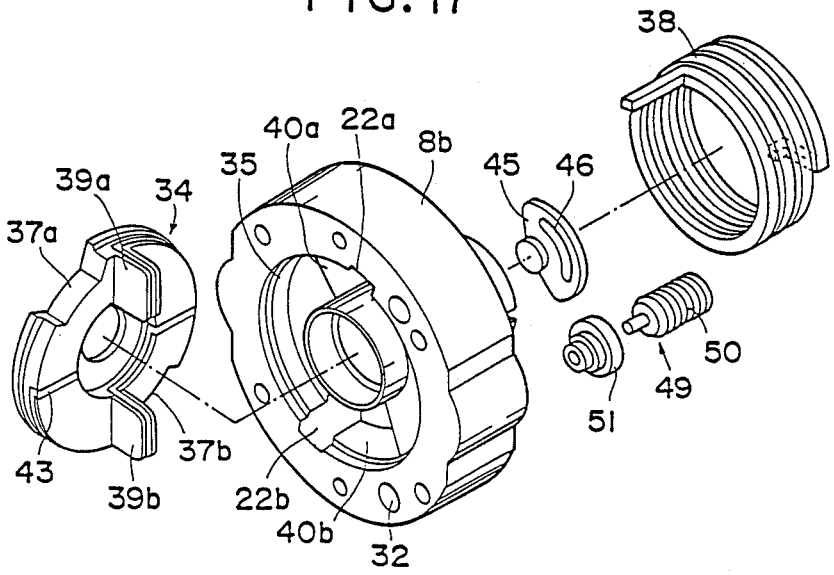
FIG. 17 is an exploded perspective view showing essential structural components of the compressor shown in FIG. 12.
Figure 18:
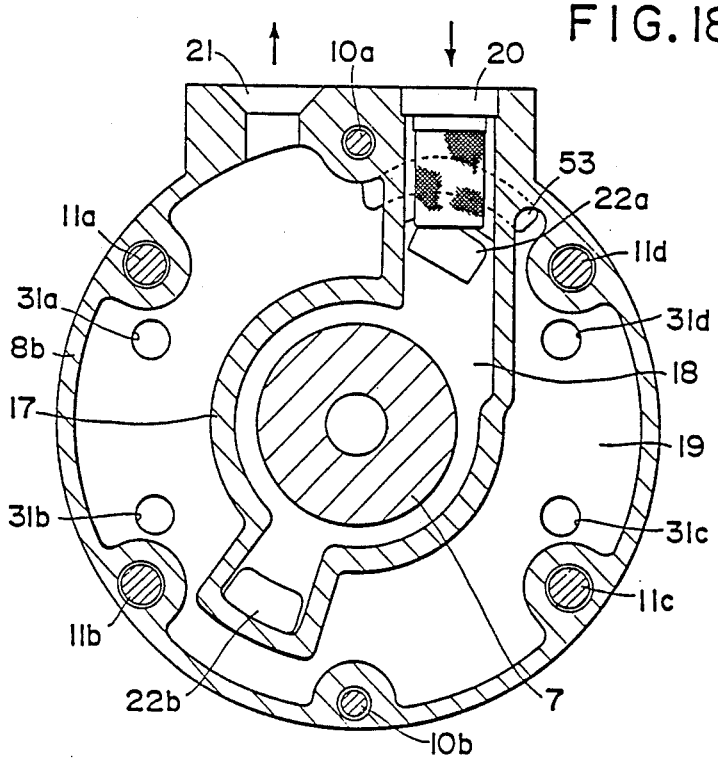
FIG. 18 is a transverse cross-sectional view showing a fourth embodiment of sliding-vane rotary compressor according to the present invention.

A torsion coil spring 38 constituting a resilient biasing or urging means is resiliently disposed and acting between the side block 7 and the adjustment member 34 for urging the latter to turn in the clockwise direction in FIG. 13. The adjustment member 34 includes a pair of tongue-like pressure-retaining portions 39*a*, 39*b* projecting perpendicularly from the body of the adjustment member 34. The pressure-retaining portions 39*a*, 39*b* are slidably received in a pair of guide grooves 40*a*, 40*b*, respectively, formed in the side block 7 and extending continuously from the intake holes 22*a*, 22*b*. Thus, there are two pressure chambers 41*a*, 41*b* defined between the guide grooves 40*a*, 40*b* and the adjustment member 34. The pressure chambers 41*a*, 41*b* are sealed from the outside by means of a seal member fitted over the adjustment member 34. The seal member has a specific configuration composed of a plurality of radially spaced inner arcuate seal portions 42 interconnected by a plurality of radially extending outer seal portions 43. The pressure chambers 41*a*, 41*b* communicate with each other via a pair of connecting holes 44*a*, 44*b* extending through the side block 7 and also via a connecting groove 46 extending in a disk-like seal member 45 disposed between the side block 7 and the second head 8*b*. One of the pressure chambers 41*a* is held in fluid communication with a high pressure chamber 19 via an orifice 47 formed in the side block 7 so that a metered flow of high pressure discharge gas is introduced into the pressure chambers 41*a*, 41*b* through the orifice 47. The other pressure chamber 41*b* is connected with a low pressure chamber 18 through a connecting passage 48 formed in the side block 7.

The connecting passage 48 is opened and closed by a control valve 49 disposed in the side block 7 and the second head 8*b*. The control valve 49 includes a bellows 50 capable of expanding and contracting in response to the pressure in the low pressure chamber 18, a ball valve element 51 connected to one end of the bellows 50, and a valve seat 52 against which the valve element 51 is seated. The control valve 49 thus constructed operates to vary the open area between the valve element 51 and the valve seat 52, thereby adjusting the rate of communication between the low pressure chamber 18 and the pressure chambers 41*a*, 41*b*.

Operation of the displacement-adjustment mechanism is described in detail. When the vehicle is cruising at low speed, the pressure in the low pressure chamber 18 is high. Under such condition, the bellows 50 of the control valve 49 is kept contracted to thereby move the valve element 51 in a direction to reduce the open area between the valve element 51 and the valve seat 52. Consequently, the amount of high pressure gas introduced through the orifice 47 into the pressure chambers 41*a*, 41*b* exceeds the amount of gas escaping from the pressure chambers 41*a*, 41*b* through the connecting passage 48 into the low pressure chamber 18. Thus the pressure in the pressure chambers 41*a*, 41*b* is increased. With this pressure rise, the adjustment member 34 is caused to turn counterclockwise against the bias of the spring 38, thereby displacing the compression starting position in the counterclockwise direction. As a result, the compression starting timing is advanced, thereby increasing the amount of gas to be trapped in the compression chambers 9*a*–9*e*. The compressor is thus driven at a large displacement.

Conversely, when the vehicle is cruising at high speed, the pressure in the low pressure chamber 18 is low. Consequently, the bellows 50 of the control valve 49 is caused to expand to thereby move the valve element 51 in a direction to increase the open area between the valve element 51 and the valve seat 52. Under such condition, the amount of gas escaping from the pressure chambers 41*a*, 41*b* is increased and hence the pressure in the pressure chambers 41*a*, 41*b* is reduced. With this pressure drop, the adjustment member 34 is caused to turn clockwise under the force of the spring 38, thereby displacing the compression starting position in the clockwise direction. As a result, the timing when the cut-out recesses 37*a*, 37*b* are closed by the succeeding vanes 6*a*–6*e* is retarded. With this delaying, gas in the compression chambers 9*a*–9*e* flows back into the low pressure chamber 18, thereby reducing the amount of gas to be compressed in the compression chambers 9*a*–9*e*. The compressor is thus driven at a reduced displacement.

Other structural details of the compressor are the same as those of the first embodiment and hence will require no further description. For easy reference, like or corresponding parts are indicated by the like or corresponding reference characters throughout several views.

Figure 8:
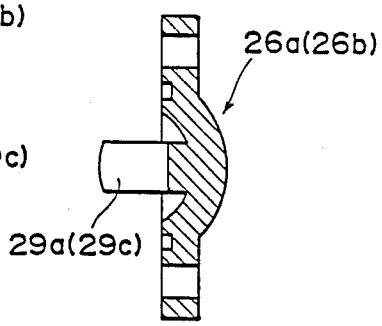
FIG. 8 is a cross-sectional view taken along line VIII—VIII of FIG. 7.

FIG. 8 shows a fourth embodiment of the present invention, wherein each of the left and right halves of a generally U-shaped high pressure chamber 19 is connected with one of a pair of valve receiving chambers (identical with the valve receiving chamber 28*a* shown in FIG. 2) via a pair of discharge connecting holes 31*a*, 31*b*; 31*c*, 31*d*, and wherein the left and right halves of the U-shaped high pressure chamber 19 are connected together via a fourth discharge connecting hole 53 defined in the second head 8*b* and extending between the opposite ends of the U-shaped high pressure chamber 19 behind an intake port 20. With this construction, an improved flow of the compressed refrigerant gas is accomplished.

Obviously, many modifications and variations of the present invention are possible in the light of the above teaching. It is therefore to be understood that within the scope of the appended claims, the invention may be practiced otherwise than as specifically described.

What is claimed is:

1. A sliding-vane rotary compressor for compressing a lubricating oil containing gas, said compressor comprising:

(a) a cylinder having an intake hole and a discharge hole, said discharge hole having first and second ends, a rotor rotatably disposed in said cylinder for defining therebetween an operating compartment, said rotor carrying thereon a plurality of substantially radially movable sliding vanes, and there being defined between said cylinder, said rotor and said vanes a plurality of compression chambers which vary in volume with each revolution of said rotor for compressing a gas sucked therein through said intake hole and for thereafter discharging the compressed gas therefrom through said discharge hole;

(b) a first head closing one of opposite open ends of said cylinder;

(c) a side block closing the other open end of said cylinder;

(d) a second head secured to said side block;

(e) said side block and said second head defining therebetween a low pressure chamber communicating with said intake hole and defining therebetween a high pressure chamber communicating with said discharge hole;

(f) a recess defined in an outer surface of said cylinder, said first end of said discharge hole opening to said operating compartment and said second end of said discharge hole opening to said recess for fluidly communicating said operating compartment and said recess;

(g) a cover secured to said cylinder and extending over said recess for closing the latter, there being defined between said cylinder and said cover a valve receiving chamber;

(h) a tubular discharge valve disposed in said valve receiving chamber for opening and closing said discharge hole;

(i) a discharge connecting hole defined in said first head, said cylinder and said side block, said discharge connecting hole extending between said recess and said high pressure chamber, and said discharge connecting hole having means for separating a lubricating oil from a lubricating oil containing gas for collecting in said high pressure chamber; and (j) an intake port and a discharge port in one of said first and second heads, said intake port communicating with said low pressure chamber, and said discharge port communicating with said high pressure chamber.

2. A sliding-vane rotary compressor according to claim 1, said first head having defined therein a discharge port connected in fluid communication with said high pressure chamber via a discharge connecting hole extending through said cylinder.

3. A sliding-vane rotary compressor according to claim 1, said high pressure chamber having a generally U-shape and extending outside of said low pressure chamber, said second head having a further discharge connecting hole extending between opposite ends of said U-shaped high pressure chamber.

4. A sliding-vane rotary compressor according to claim 1, wherein said means for separating a lubricating oil from a lubricating oil containing gas includes a zig-zag-shaped fluid passage of said discharge connecting hole.

* * * * *